US005797363A

United States Patent [19]

Nakamura

[11] Patent Number: 5,797,363

[45] Date of Patent: Aug. 25, 1998

[54] ENGINE VALVE ADJUSTER

[75] Inventor: Hideo Nakamura, Toyota, Japan

[73] Assignee: Toyota Jidosha Kabushiki Kaisha, Toyota, Japan

[21] Appl. No.: 927,997

[22] Filed: Sep. 11, 1997

[30] Foreign Application Priority Data

Sep. 13, 1996 [JP] Japan ..... 8-243604

[51] Int. Cl.[6] ..... F01L 1/344; F01L 13/00; F02D 13/02

[52] U.S. Cl. ..... 123/90.17; 123/90.31; 123/41.33; 123/196 A; 123/196 AB

[58] Field of Search ..... 123/90.12, 90.15, 123/90.16, 90.17, 90.18, 90.31, 90.33, 90.34, 41.33, 196 A, 196 AB, 196 M

[56] References Cited

U.S. PATENT DOCUMENTS 4,174,699 11/1979 Gill ..... 123/196 A 4,352,455 10/1982 Moser et al. ..... 123/196 AB 5,271,360 12/1993 Kano et al. ..... 123/90.17

FOREIGN PATENT DOCUMENTS 828219A 1/1996 Japan .

*Primary Examiner*—Weilun Lo

*Attorney, Agent, or Firm*—Kenyon & Kenyon

[57] ABSTRACT

A variable valve timing mechanism (VVT) for adjusting the valve timing of an intake valve of an internal combustion engine. The VVT has first and second pressure chambers for receiving oil. An oil control valve (OCV) is provided for controlling oil flow from a pump. Passages are provided for connecting the OCV to the pressure chambers to supply oil to the chambers in a controlled manner. A filter is located in the passage for filtering the oil. The filter is supported in water jacket where coolant flows. The filter is heated by the coolant to decrease the flow resistance of the oil.

13 Claims, 5 Drawing Sheets

ENGINE VALVE ADJUSTER

BACKGROUND OF THE INVENTION

The present invention relates to a variable valve timing mechanism provided in an engine to change the valve timing of intake valves or exhaust valves. More particularly, the present invention pertains to a variable valve timing mechanism that is driven by fluid pressure.

A variable valve timing mechanism (hereafter referred to as VVT) is provided in an engine to displace the rotational phase of a camshaft and adjust the valve timing of either an intake valve or an exhaust valve. The operation of the VVT optimizes the valve timing in accordance with the operating state of the engine (engine load, engine speed, and other factors). This improves fuel economy, increases engine power, and suppresses undesirable engine emissions regardless of different operating states of the engine.

Japanese Unexamined Patent Publication No. 8-28219 discloses a vane type VVT, an example of which is shown in FIG. 6.

As shown in FIG. 6, a VVT 81 includes a camshaft 82, a ring gear 84 and a cover 96. The ring gear 84 has helical splines 83 formed on the periphery. The cover 96 is fitted on the camshaft 82 with the ring gear 84 placed in between. The ring gear 84 is urged leftward (as viewed in the drawing) by a spring 85. A pulley 92 is secured to the cover 96 and coupled to the crankshaft of an engine (both not shown). The VVT 81 also includes hydraulic chambers 88, 89 defined next to the front and rear end faces of the ring gear 84, respectively.

The oil pressure from an oil pump 86 is controlled by a linear solenoid type oil control valve (OCV) 87. The controlled pressure is selectively communicated with the hydraulic chambers 88 and 89 defined in the VVT 81.

The OCV 87 includes a sleeve 90 and a spool 91. The spool 91 is slidably accommodated in the sleeve 90. A linear solenoid 95 is secured to one end of the sleeve 90 for reciprocating the spool 91. When the engine is running, current is fed to the solenoid 95. The position of the spool 91 in the sleeve 90 is changed by controlling the current. Accordingly, the pressure of oil discharged from the OCV 87 is controlled and the oil is selectively supplied to the hydraulic chambers 88 and 89.

The oil pressures in the hydraulic chamber 88, 89 act on the ring gear 84 thereby displacing the ring gear 84 along the axial direction of the camshaft 82. The displacement of the ring gear 84 changes (advances or retards) the rotational phase of the camshaft 82 relative to the pulley 92. As a result, the valve timing of valves (not shown), which are opened and closed as the camshaft 82 rotates, is adjusted.

Foreign matter is removed from the oil by an oil filter 94 located between the pump 86 and the OCV 87.

The filter 94 generally includes a fine mesh for improving its performance, that is, for catching smaller foreign matter. Thus, if oil having a high viscosity is used, flow resistance of the oil passing through the filter 94 becomes great and significantly lowers the pressure of the oil downstream of the filter 94. This deteriorates the response of the VVT 81, which is driven by the pressure of the oil.

Typically, the filter 94 is provided on a cover covering the camshaft 82. This construction exposes the housing of the filter 94 to the ambient air, which cools the oil and thus further increases its flow resistance. This further reduces the responsiveness of the VVT.

SUMMARY OF THE INVENTION

Accordingly, it is an objective of the present invention to improve the response of a variable valve performance mechanism that is actuated by oil pressure.

To achieve above objective, the present invention provides an apparatus for adjusting the valve performance of an internal combustion engine valve. The apparatus has a pressure chamber for receiving oil, wherein the apparatus is hydraulically driven by the oil pressure. The apparatus includes a reservoir for reserving oil, a pump for discharging the oil from the reservoir, a control valve for controlling the oil flow from the pump, a passage for connecting the control valve to the pressure chamber to supply the oil to the pressure chamber, a filter positioned in the passage for filtering the oil, and a heater for heating the filter to a temperature that is approximately the same as that of an interior part of the engine.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

FIG. 1 is taken along line 1—1 of FIG. 2;

DETAILED DESCRIPTION OF THE PREFERRED EMBODIMENTS

The variable valve timing mechanism according to the present invention will be described below referring to FIGS. 1 to 5.

Figure 3:
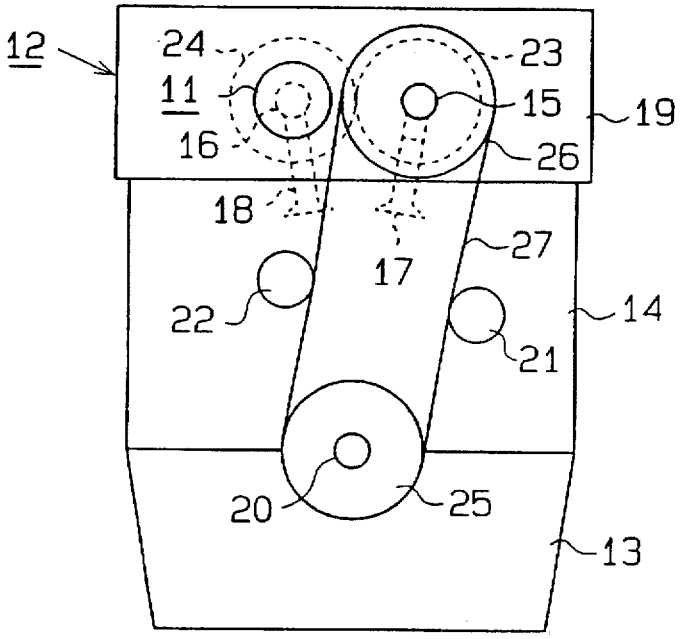
FIG. 3 shows a diagrammatic front view of an engine containing the VVT according to the present invention.

An engine 12 having a valve train that includes a vane-type VVT 11 is shown in FIG. 3. The engine 12 includes an oil pan 13 for reserving lubricating oil, a cylinder block 14 provided with cylinders (not shown) and a cylinder head 19. The cylinder head 19 supports an exhaust camshaft 15, an intake camshaft 16, exhaust valves 17 and intake valves 18.

The cylinder block 14 rotatably supports a crankshaft 20. Tensioners 21, 22 are arranged at predetermined positions on the cylinder block 14. The cylinder head 19 rotatably supports the exhaust camshaft 15 for opening and closing the exhaust valves 17. The cylinder head 19 also rotatably supports the intake camshaft 16 for opening and closing the intake valves 18. A drive gear 23, which is attached to the exhaust camshaft 15 is meshed with a driven gear 24 attached to the intake camshaft 16. The VVT 11 is provided at a distal end of the intake camshaft 16. Sprockets 25, 26 are provided at distal ends of the crankshaft 20 and the exhaust camshaft 15, respectively. A chain 27 is wound about the sprockets 25, 26 to connect the exhaust camshaft 15 to the crankshaft 20. Tension is applied to the wound chain 27 by the tensioners 21, 22.

The rotation of the crankshaft 20 is transmitted to the camshaft 15 by means of the chain 27 and the sprockets 25, 26. Then, the rotation of the exhaust camshaft 15 is transmitted to the intake camshaft 16 by means of the gears 23, 24. This rotates the camshafts 15, 16 synchronously with the crankshaft 20. The rotation of the camshafts 15, 16 selectively opens and closes the associated exhaust and intake valves 17, 18 in accordance with a predetermined timing.

Figure 1:
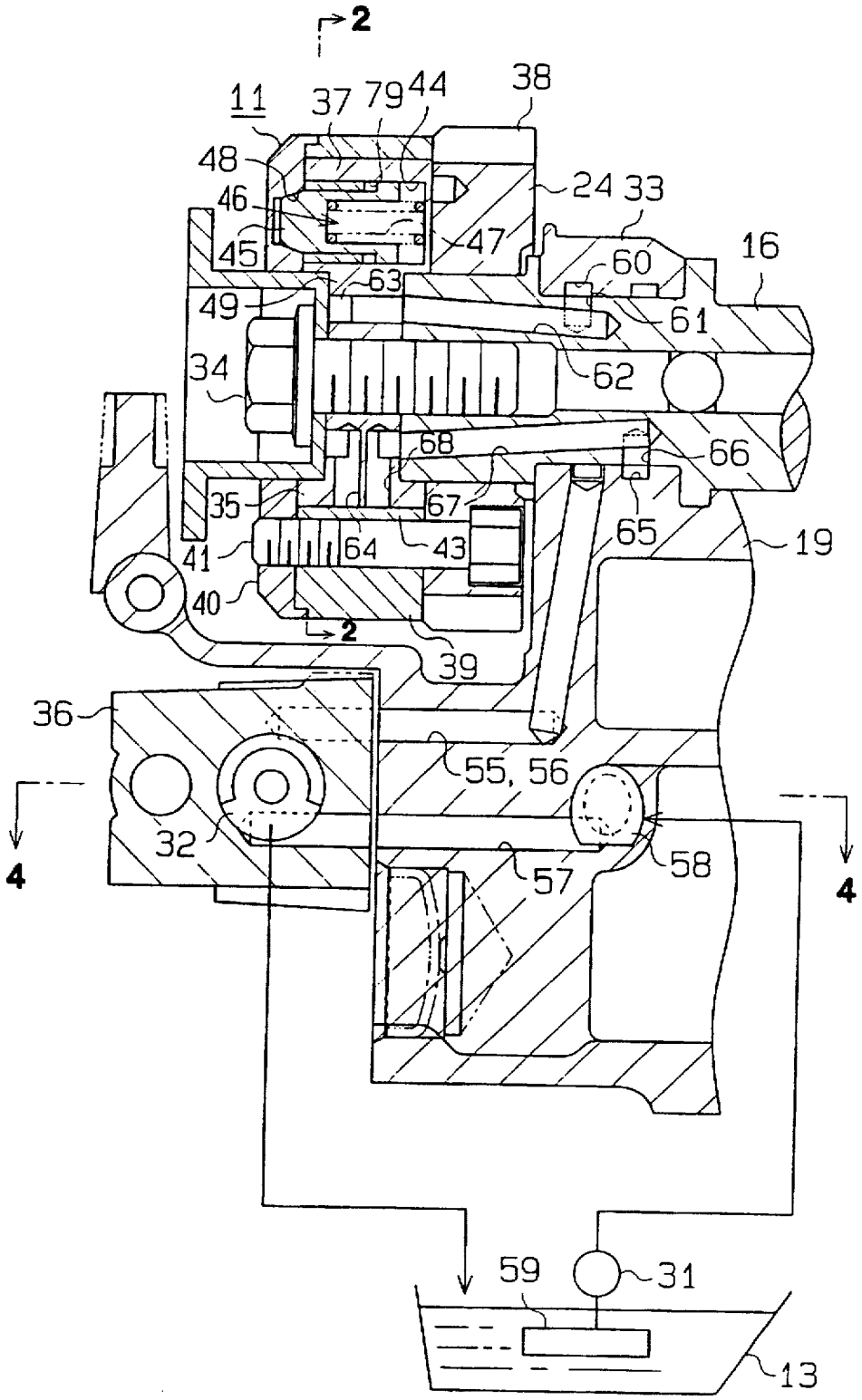
FIG. 1 shows a partial cross-sectional view of the VVT and a cylinder head according to the present invention.

FIG. 1 is a cross-sectional view illustrating a VVT 11 provided on the distal end of the intake camshaft (hereinafter referred to as "camshaft") 16, an oil pump 31 for supplying oil to the VVT 11 and an oil control valve (OCV) 32 for controlling the pressure of oil supplied to the VVT 11.

As shown in FIG. 1, the VVT 11 contains the camshaft 16, a rotor 35 fixed to the left end of the camshaft 16, a housing 39 surrounding the rotor 35, the driven gear 24 fixed to the housing 39 and a cover 40 covering the housing 39.

The camshaft 16 is rotatably supported by the cylinder head 19 and a bearing cap 33. The rotor 35 is fixed to the left end of the camshaft 16 by a bolt 34 and is rotated integrally with the camshaft 16. The rotor 35 has a plurality of vanes 37.

The housing 39 surrounds the rotor 35 and is rotatable relative to the camshaft 16 and the rotor 35. The cover 40 and the driven gear 24 are fixed to opposite sides of the housing 39, respectively, by bolts 41 and are both rotatable relative to the camshaft 16 and the rotor 35. The driven gear 24 has a thick ring-like shape and has a plurality of outer teeth 38 formed on its circumference. The driven gear 24 is rotatably supported on outer surface of the camshaft 16.

One of the vanes 37 has a hole 44 extending parallel to the axis of the camshaft 16. A lock pin 45 is slidably accommodated in the hole 44. The lock pin 45 has a recess 46 defined therein. A spring 47 is housed in the recess 46 for urging the pin 45 toward the cover 40. The cover 40 has a recess 48 with which the pin 45 is engaged in the view of FIG. 1. Engagement of the pin 45 with the recess 48 restricts rotation of the rotor 35 relative to the housing 39. Accordingly, the camshaft 16 rotates integrally with the driven gear 24 when the pin 45 engages the recess 48.

Figure 2:
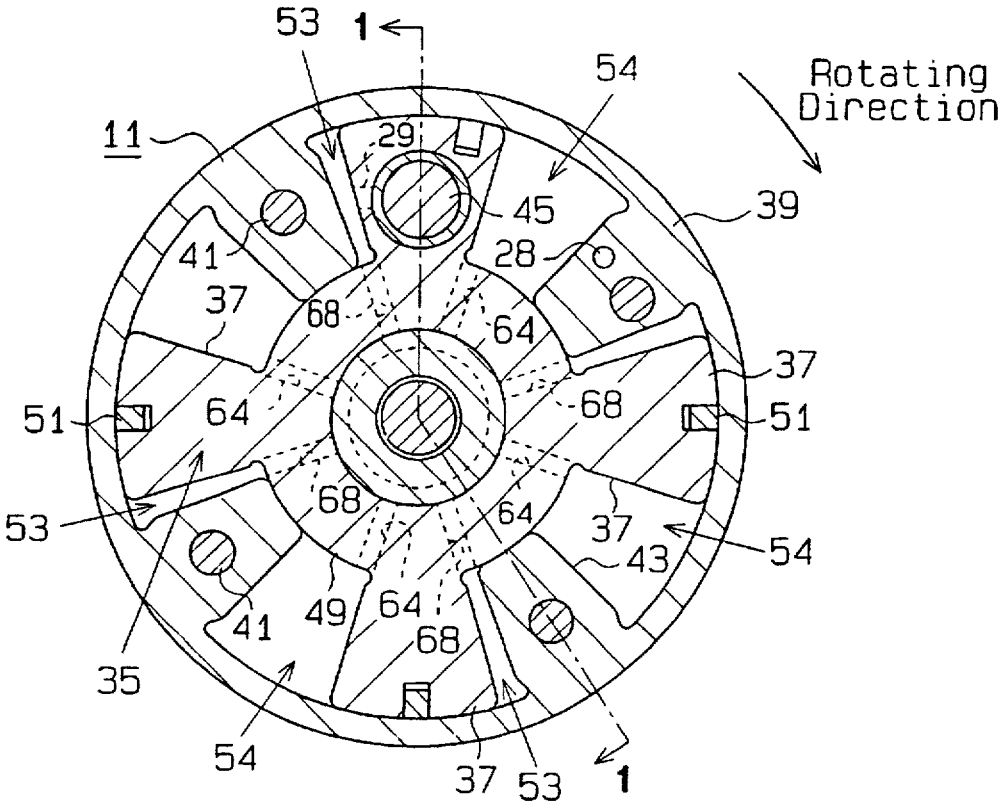
FIG. 2 shows a cross-sectional view taken along the line 2—2 of FIG. 1.

As shown in FIG. 2, the housing 39 and the rotor 35 are rotated clockwise. The housing 39 and the rotor 35 shown in FIG. 2 are in their initial positions, at which the valve timing of the intake valves 18 is delayed most.

The rotor 35 consists of a boss 49 and the above mentioned vanes 37, the number of which is four in this embodiment. The vanes 37 protrude radially outward from the boss 49. These four vanes 37 are arranged at approximately 90 degree intervals. A seal 51 is attached to the distal end of each vane 37 to seal between the inner circumference of the housing 39 and the outer circumference of the boss 49.

The housing 39 has four inward protrusions 43, and every two adjacent protrusions 43 define a recess. The outer circumference of the boss 49 is brought into contact with the end faces of the protrusions 43. The vanes 37 are housed in the recesses of the housing 39 respectively. Each vane 37 defines, in the corresponding recess, a first hydraulic chamber 53 and a second hydraulic chamber 54. The first hydraulic chamber 53 is located on the trailing side with respect to the rotating direction of the vane 37, while the second hydraulic chamber 54 is located on the leading side. Oil pressure is supplied to the hydraulic chambers 53, 54 selectively so as to rotate the rotor 35 with respect to the housing 39.

The hole 44, which is defined in one of the vanes 37 for accommodating the lock pin 45, is communicated with one of the first hydraulic chambers 53 by an oil passage 29. As described below, oil is supplied to the hole 44 through the passage 29, and the pressure of the supplied oil moves the lock pin 45 rightward against the force of the spring 47 (shown in FIG. 1). This permits the rotor 35 to rotate relative to the housing 39. The housing 39 is fixed to the driven gear 24 and the cover 40 (shown in FIG. 1) by the bolts 41 and a knock-pin 28 provided in one of the protrusions 43.

The following description covers the construction of passages for providing and draining oil to and from the first and second hydraulic chambers 53, 54.

As shown in FIG. 1, the cylinder head 19 has first and second oil conduits 55, 56 defined therein. In FIG. 1, the conduits 55, 56 are aligned and therefore only one is visible. The OCV 32 is covered with a housing 36 and has a plurality of ports 69–73 (shown in FIG. 4). The port 73 is connected to the oil pan 13 by a supply passage 57, an oil filter 58, a pump 31 and an oil strainer 59.

The first oil conduit 55 is communicated with an oil groove 65 formed in the top portion of the cylinder head 19 and the bearing cap 33. An oil hole 66 and an oil passage 67 are formed in the camshaft 16 for communicating the groove 65 with oil bores 68. The oil bores 68 communicate the first hydraulic chambers 53 and the oil passage 67 thereby supplying oil to the chambers 53. An annular release chamber 79 is defined about the lock pin 45. The chamber 79 is communicated with the oil passage 29 (FIG. 2).

When oil pressure is supplied to the first hydraulic chambers 53 through the first oil conduit 55, the passage 29 (shown in FIG. 2) communicates the supplied oil pressure with the release chamber 79. The oil pressure moves the lock pin 45 rightward as viewed in FIG. 1 against the force of the spring 47 thereby disengaging the pin 45 from the recess 48. This allows the rotor 35 to rotate with respect to the housing 39. Therefore, the oil pressure supplied to the first hydraulic chambers 53 rotates the rotor 35 clockwise relative to the housing 39 (as viewed in FIG. 2). This advances the rotational phase of the rotor 35 relative to the housing 39. Accordingly, the rotational phase of the camshaft 16 is advanced. As a result, the valve timing of the intake valves 18 (shown in FIG. 3), which are driven by the shaft 16, is advanced.

An oil passage 62 is formed in the camshaft 16 substantially along the axis of the shaft 16, and an oil groove 60 is formed in the inner surface of the cylinder head 19 and the bearing cap 33. The second oil conduit 56 is communicated with the oil passage 62 by the oil groove 60 and an oil hole 61. One end of the passage 62 opens to an annular chamber 63 defined in the boss 49 of the rotor 35. As illustrated in FIGS. 1 and 2, four oil passages 64 are radially formed in the boss 49 of the rotor 35 for communicating the annular chamber 63 with the second hydraulic chambers 54. Thus, the passages 64 supply oil from the chamber 63 to the second hydraulic chambers 54.

When oil pressure is supplied to the second hydraulic chambers 54 through the second oil conduit 56, the rotor 35 is rotated counterclockwise relative to the housing 39 as viewed in FIG. 2. This retards the rotational phase of the rotor 35 relative to the housing 39. Accordingly, the rotational phase of the camshaft 16 is retarded. As a result, the valve timing of the intake valves 18 (shown in FIG. 3), which are driven by the shaft 16, is retarded.

Figure 4:
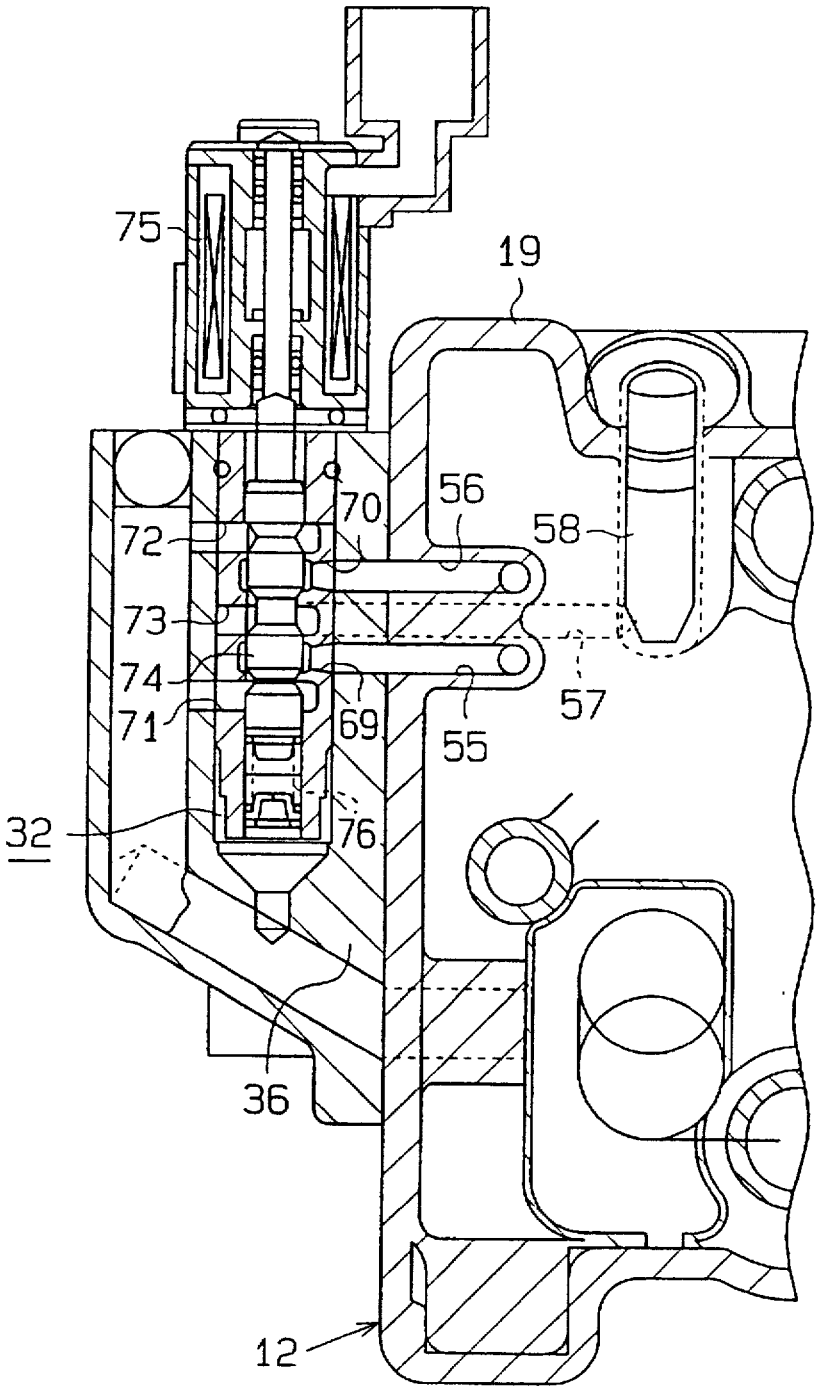
FIG. 4 shows a cross-sectional view taken along the line 4—4 of FIG. 1.

As shown in FIG. 4, the OCV 32 has five ports 69–73 to switch the direction of supplying and discharging the oil and to adjust the oil pressure supplied to the hydraulic chambers 53 and 54, respectively. A first port 69 is connected to the first oil conduit 55, while a second port 70 is connected to the second oil conduit 56. Drain ports 71, 72 are connected to the oil pan 13 (shown in FIG. 1), while a supply port 73 is connected via a supply passage 57 and the oil filter 58 to the pump 31 (shown in FIG. 1).

The OCV 32 is provided with a solenoid actuator 75, a spool 74 and a coil spring 76 for moving the spool 74. An electronic control unit (ECU, not shown) duty controls the solenoid 75 for reciprocating the spool 74 in the axial direction. This reciprocating motion of the spool 74 adjusts of the amount of oil supplied to the hydraulic chambers 53, 54.

The spring 76 is located in the housing 36 for urging the spool 74 rightward as viewed in FIG. 4, or toward a "retarded position". Stopping the supply of current to the solenoid 75 allows the spring 76 to move the spool 74 to the "retarded position". When the spool 74 is at the "retarded position", oil is supplied to the second hydraulic chambers 54 in the VVT 11 and thus the valve timing of the intake valves 18 is retarded. Contrarily, supplying current to the solenoid 75 moves the spool 74 leftward as viewed in FIG. 4, or toward an "advanced position". When the spool 74 is at the "advanced position", oil is supplied to the first hydraulic chambers 53 and thus the valve timing of the intake valves 18 is advanced.

As described above, the oil filter 58 for removing foreign matter from oil is located between the pump 31 (shown in FIG. 1) and the supply passage 57. The filter 58 is located in a water jacket 77 (shown in FIG. 5) of the engine 12.

Figure 5:
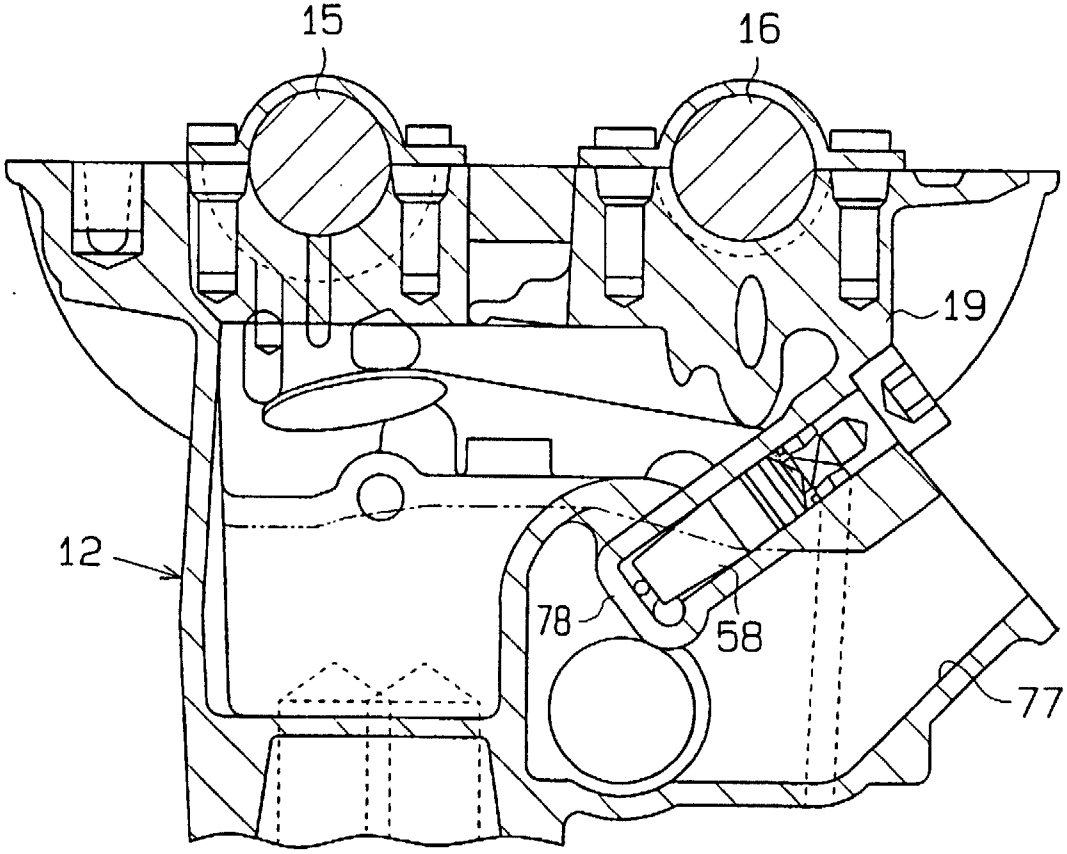
FIG. 5 shows a cross-sectional view of an engine containing an oil filter.
Figure 6:
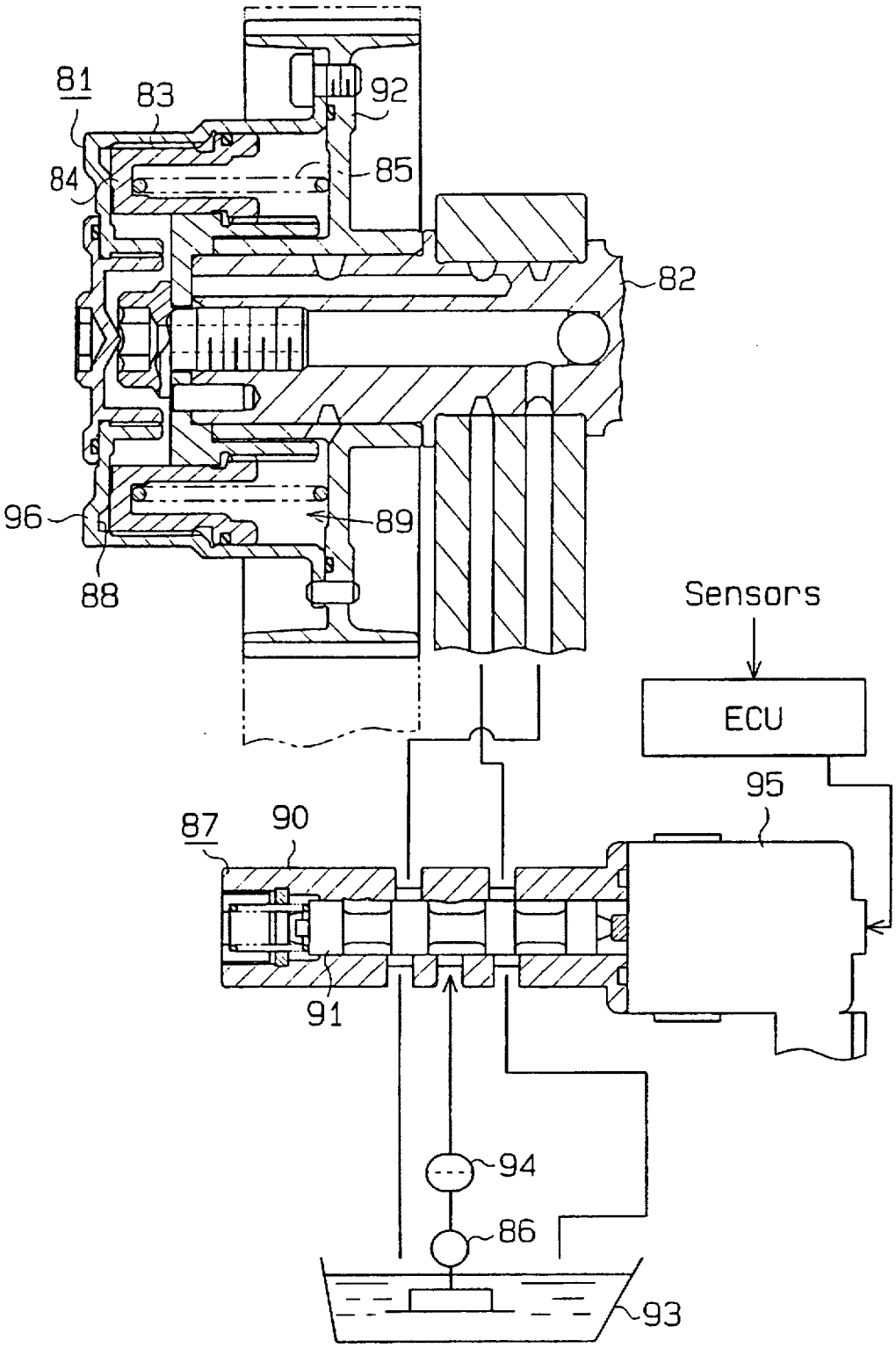
Fig.6 (Prior Art)
FIG. 6 shows a cross-sectional view of the prior art VVT.

FIG. 5 is a cross-sectional view of the engine 12 as viewed from the rear side and accurately shows the position of the filter 58 in the engine 12.

As shown in FIG. 5, the water jacket 77 is defined in the cylinder head 19. Coolant water circulates in the jacket 77 for cooling the engine 12. The oil filter 58 is held in an inclined position by a holder 78 formed in the jacket 77. The holder 78 is exposed to the coolant water. Specifically, the lower portion of the holder 78 extends into the water jacket 77 for enlarging the area contacting the coolant water. The oil filter 58 includes a fine mesh for catching minute foreign matter in the oil.

The following discussion covers the reasons for locating the filter 58 in the water jacket 77.

As described above, when the engine 12 is running, rotation of the exhaust and intake camshafts 15, 16 selectively opens and closes the exhaust and intake valves 17, 18 in accordance with a predetermined timing. The VVT 11 is actuated by oil pressure supplied to the first and second hydraulic chambers 53, 54, and changes the valve timing of the intake valves 18. During operation of the VVT 11, the pump 31 supplies oil to the OCV 32 via the oil filter 58. The OCV 32 controls the pressure of the oil discharged therefrom. Minute foreign matter is caught by the filter 58 and removed from the oil.

The temperature of the oil is low, for example, when the engine 12 is first started. At this time, the temperature of the oil filter 58 is also low. The temperature of the oil filter 58 affects the flow resistance of the oil passing through the filter 58. The low temperature of the oil filter 58 raises the flow resistance of the oil in the vicinity of the oil filter 58, which affects all of the oil in circulation. However, the oil filter 58 is exposed to the coolant water circulating in the water jacket 77. Thus, as the coolant water is warmed, the heat of the coolant water raises the temperature of the oil filter 58. The water jacket 77 and the coolant water therefore serve as a heater for the oil filter 58.

Heat of the coolant water quickly raises the temperature of the oil filter 58. Accordingly, the flow resistance of the oil in the vicinity of the filter 58 is lowered and thus improved.

In this manner, the above described apparatus improves the flow resistance of oil in the vicinity of the oil filter 58. Thus, quick VVT response is achieved soon after the engine 12 is started.

When the engine 12 is running under heavy load, the temperature of the oil may be higher than the temperature of the coolant water. In this case, the oil is cooled by the coolant water. This prevents the oil temperature from becoming too high. If the oil temperature is too high, the clearances between each sliding part in the VVT 11 is enlarged and the oil may leak from the clearances. This results in lower hydraulic pressure in the VVT 11, thereby deteriorating the response of the VVT 11. However, the illustrated apparatus prevents the oil temperature from being too high thereby improving the response of the VVT 11 when the engine 12 is running under heavy load.

Further, in the preferred and illustrated embodiment, the coolant water cools the engine 12 and, at the same time, warms the oil filter 58. In this manner, the heat of the engine 12 is effectively used. This eliminates the necessity for an extra device for heating the oil filter 58.

It should be apparent to those skilled in the art that the present invention may be embodied in many other specific forms without departing from the spirit or scope of the invention. Particularly, it should be understood that the invention may be embodied in the following forms.

(1) The present invention may be embodied in any hydraulic type variable valve performance mechanisms other than vane type VVTs such as the VVT 11. For example the present invention may be used with a VVT like the VVT 81 having the ring gear 84, which is described in DESCRIPTION OF THE RELATED ART section.

(2) In the illustrated embodiment, the valve timing of the intake valves 18 is variable. However, the valve lift of the intake valves 18 may instead be variable. Further, both valve timing and valve lift of the intake valves 18 may be variable. In this case, the camshaft is provided with a plurality of sets of cams of different lifts and is axially movable. One of the cams is chosen as the axial position of the camshaft is selected. Alternatively, the nose of each cam may be tapered along the axis of the camshaft such that a movement of the camshaft along its axis changes the valve lift of the valves.

(3) In the illustrated embodiment, the valve timing of the intake valves 18 is changed. However, the valve timing of the exhaust valves 17 may be variable. In this case, the VVT 11 is provided on the exhaust camshaft 15. Further, a VVT 11 may be provided on each of the intake and exhaust camshafts 16, 15 for changing the valve timings of both intake and exhaust valves 18, 17.

(4) In the illustrated embodiment, the VVT 11 provided on the intake camshaft 16 changes the rotational phase of the camshaft 16 thereby varying the valve timing of the intake valves 18. However, the VVT 11 provided on the intake camshaft 16 may change the rotational phase of the exhaust camshaft 15 thereby varying the valve timing of the exhaust valves 17. In this case, the sprocket 26 on the exhaust camshaft 15 and the chain 27 are omitted and a sprocket is secured to the proximal end of the intake camshaft 16 in FIG. 1. This sprocket is coupled to the crankshaft 20 by the chain 27.

(5) In the illustrated embodiment, the water jacket 77 and the coolant water constitute a heater. However, other constructions may be used for heating the filter 58. For example, an electric heater may be used to heat the filter 58. In this case, the heater is located in the vicinity of the filter 58 for heating the heater 58. This construction increases the temperature of the filter 58 even if the temperature of the coolant water is low thereby quickly improving the flow resistance of the oil.

Therefore, the present examples and embodiments are to be considered as illustrative and not restrictive and the invention is not to be limited to the details given herein, but may be modified within the scope and equivalence of the appended claims.

What is claimed is:

1. An apparatus for adjusting the valve performance of an internal combustion engine valve, the apparatus having a pressure chamber for receiving oil, wherein the apparatus is hydraulically driven by the oil pressure, the apparatus comprising:

a reservoir for reserving oil;

a pump for discharging the oil from the reservoir;

a control valve for controlling the oil flow from the pump;

a passage for connecting the control valve to the pressure chamber to supply the oil to the pressure chamber;

a filter positioned in the passage for filtering the oil; and a heater for heating the filter to a temperature that is approximately the same as that of an interior part of the engine.

2. The apparatus according to claim 1, wherein a combustion chamber in the engine serves as the heater, and combustion heat is employed to heat the filter.

3. The apparatus according to claim 2, wherein the engine includes a cooling jacket and liquid coolant for cooling the engine and wherein the filter is heated by the coolant.

4. The apparatus according to claim 3, further comprising a filter holder located in the jacket for supporting the filter, wherein the holder has an outer surface that contacts the coolant.

5. The apparatus according to claim 4, wherein the holder has a portion that protrudes into the jacket to increase the heat transfer area of the outer surface, which contacts the coolant.

6. The apparatus according to claim 1, further comprising:

a camshaft for actuating the valve;

a housing mounted on the camshaft, the housing being rotatable relative to the camshaft;

an actuator, which is coupled to the housing and the camshaft, for changing the relative rotational relationship between the camshaft and the housing;

a first pressure chamber for applying oil pressure to said actuator to move the actuator in a first direction;

a second pressure chamber for applying oil pressure to said actuator to move the actuator in a second direction;

a first conduit for connecting the control valve to the first pressure chamber to supply oil to the first pressure chamber; and a second conduit for connecting the control valve to the second pressure chamber to supply oil to the second pressure chamber.

7. The apparatus according to claim 6, wherein the control valve includes a supply port for receiving filtered oil, a discharge port for supplying oil to each pressure chamber, and a drain port for draining oil to the reservoir.

8. The apparatus according to claim 1, wherein the valve is an intake valve.

9. An oil supply structure for a mechanism that adjusts the valve performance of a valve of an internal combustion engine, wherein the mechanism has a pressure chamber for receiving oil, wherein the mechanism is driven by hydraulic oil pressure, the structure comprising:

a reservoir for reserving an oil;

a pump for discharging oil from the reservoir;

a control valve for controlling the flow of oil discharged from the pump;

a passage for connecting the control valve to the pressure chamber to supply oil to the pressure chamber;

a filter positioned in the passage for filtering the oil; and a heater for heating the filter to a temperature that is approximately the same as that of an interior part of the engine.

10. The structure according to claim 9, wherein a combustion chamber in the engine serves as the heater, and combustion heat is employed to heat the filter.

11. The structure according to claim 10, wherein the engine includes a cooling jacket and liquid coolant for cooling the engine and wherein the filter is heated by the coolant.

12. The structure according to claim 11, further comprising a filter holder located in the jacket for supporting the filter, wherein the holder has an outer surface that contacts the coolant.

13. The structure according to claim 9, further comprising:

a camshaft for actuating the valve;

a housing mounted on the camshaft, the housing being rotatable relative to the camshaft;

an actuator, which is coupled to the housing and the camshaft, for changing the relative rotational relationship between the camshaft and the housing;

a first pressure chamber for applying oil pressure to said actuator to move the actuator in a first direction;

a second pressure chamber for applying oil pressure to said actuator to move the actuator in a second direction;

a first conduit for connecting the control valve to the first pressure chamber to supply oil to the first pressure chamber; and a second conduit for connecting the control valve to the second pressure chamber to supply oil to the second pressure chamber.

* * * * *